US011674385B2

(12) United States Patent
Hudson et al.

(10) Patent No.: US 11,674,385 B2
(45) Date of Patent: Jun. 13, 2023

(54) DOWNHOLE COMMUNICATION

(71) Applicant: METROL TECHNOLOGY LTD, Aberdeen (GB)

(72) Inventors: Steve Martin Hudson, Aberdeen (GB); Leslie David Jarvis, Aberdeen (GB)

(73) Assignee: METROL TECHNOLOGY LTD., Aberdeen (GB)

( * ) Notice: Subject to any disclaimer, the term of this patent is extended or adjusted under 35 U.S.C. 154(b) by 184 days.

(21) Appl. No.: 17/041,707

(22) PCT Filed: Mar. 29, 2018

(86) PCT No.: PCT/GB2018/050885
§ 371 (c)(1),
(2) Date: Sep. 25, 2020

(87) PCT Pub. No.: WO2019/186086
PCT Pub. Date: Oct. 3, 2019

(65) Prior Publication Data

US 2021/0131274 A1 May 6, 2021

(51) Int. Cl.
*E21B 47/13* (2012.01)
*E21B 47/001* (2012.01)

(52) U.S. Cl.
CPC ..... *E21B 47/13* (2020.05); *E21B 47/001* (2020.05)

(58) Field of Classification Search
CPC ..... E21B 47/13; E21B 47/001
See application file for complete search history.

(56) References Cited

U.S. PATENT DOCUMENTS 6,018,301 A * 1/2000 Smith ..... E21B 47/017 340/854.4
6,965,320 B1 * 11/2005 Casey ..... F16L 55/48 346/33 P (Continued)

FOREIGN PATENT DOCUMENTS

DE 112016002545 T5 * 4/2018 ..... E21B 47/122
EP 0314654 A1 * 5/1989 ..... E21B 47/12

OTHER PUBLICATIONS

International Search Report and Written Opinion of the ISA for PCT/GB2018/050885 dated Dec. 4, 2018, 9 pages.

*Primary Examiner* — Amine Benlagsir
(74) *Attorney, Agent, or Firm* — Nixon & Vanderhye, PC

(57) ABSTRACT

A downhole communication system for communication between a first and second location in a subsea oil and/or gas well installation. The oil and/or gas well installation comprises out of hole metallic structure comprising a riser 3 running upwards away from the mudline ML, and downhole metallic structure 2 running down into the well. The communication system is arranged so that at least part of a signal path for communications between the first and second locations is provided by the downhole metallic structure 2 such that, in use, data to be communicated between the first and second locations is carried by electrical signals in the downhole metallic structure 2. The communication system further comprises a first noise cancellation arrangement arranged for sensing a noise signal generated in the out of hole metallic structure and arranged for applying a corresponding noise cancelling signal to the out of hole metallic structure or the downhole metallic structure to inhibit introduction of electrical noise into the downhole metallic structure 2 from the riser 3.

26 Claims, 10 Drawing Sheets

(56) References Cited

U.S. PATENT DOCUMENTS

| | | | | |
|---|---|---|---|---|
| 2006/0187755 | A1* | 8/2006 | Tingley | E21B 47/16 367/82 |
| 2007/0263488 | A1* | 11/2007 | Clark | E21B 47/18 367/87 |
| 2010/0078161 | A1* | 4/2010 | Krueger | E21B 29/005 166/65.1 |
| 2011/0163830 | A1* | 7/2011 | Hudson | G01V 11/002 334/17 |
| 2012/0126992 | A1* | 5/2012 | Rodney | G01V 11/002 340/850 |
| 2015/0285937 | A1* | 10/2015 | Keller | E21B 49/00 166/250.1 |
| 2018/0073320 | A1* | 3/2018 | Holmes | F15B 1/02 |
| 2018/0252092 | A1* | 9/2018 | Plotnikov | G01B 7/12 |
| 2018/0291729 | A1* | 10/2018 | Wilson | E21B 47/13 |
| 2019/0293823 | A1* | 9/2019 | Sun | G01V 1/50 |

* cited by examiner

DOWNHOLE COMMUNICATION

This application is the U.S. national phase of International Application No. PCT/GB2018/050885 filed Mar. 29, 2018, the entire contents of which are hereby incorporated by reference.

This invention relates to downhole communication systems and methods.

Wireless EM (electro-magnetic) communication systems are widely used now in downhole data telemetry systems. Such systems can be used for measuring parameters downhole and communicating these to the surface and/or for communication within the well and/or for controlling the operation of devices provided downhole.

In at least some such systems, the downhole metallic structure provided in the borehole of the well is used as at least part of a signal channel. For example, this may be for communication between the surface and a downhole location at which a communication unit is provided. One situation where such communication systems are used are subsea wells.

There are two broad types of subsea well. Those with a well head at the mudline/seabed and a riser rising away from this towards a floating platform (or vessel) and those where the well head is provided on a fixed platform spaced away from the mudline and downhole metallic pipe exits the borehole at the seabed and continues towards the well head as a riser.

Where a well head is provided at the mudline, a Lower Marine Riser Package (LMRP) may be provided via which the riser is connected to the well head.

In any such case a surface communication unit may be located at the seabed/mudline or close thereto for picking up signals from metallic structure at the seabed which have been communicated up the downhole structure, and through the well head, where present. Similarly such a surface unit may be used for applying signals to the metallic structure at the mudline for transmission downhole via the well head, when present, and the downhole metallic structure.

Similarly there may be communication between two downhole locations.

Such communication systems can be made to work effectively in completed or abandoned subsea wells with a well head at the mudline for example. However, problems arise when a riser is present. Such a riser may be connected to a subsea well head, for example, during installation and completion of a well or during workover of a well or may be present long term—either connected to a well head or in a fixed platform installation.

Without a riser in place there is no low impedance path for noise and hence noise levels at a seabed unit are much reduced due to screening provided by the seawater. The deeper the seawater, the lower the noise that will be expected at the surface unit in the absence of a riser. This lower level of noise will also be seen lower in the well in the downhole structure.

When a riser is present however, electrical noise is injected into the well as a result of this being collected or generated in the riser and/or in the structure supporting the riser. This can lead to a decrease in signal to noise ratio at receiver units which can render it difficult or impossible to achieve detection of signals.

Noise collected, or generated, in the riser or structure supporting the riser can come from many sources, for example, atmospheric electricity, rotating machinery, communication equipment, and corrosion. All of these added together cause a noise current which will flow down the riser and into the well which provides a very low impedance to ground.

Thus it would be desirable to provide a system which allows a good communication even in the presence of a riser.

According to one aspect of the present invention there is provided a downhole communication system for communication between a first and second location in a subsea oil and/or gas well installation, the oil and/or gas well installation comprising: out of hole metallic structure comprising a riser running upwards away from the mudline, and downhole metallic structure running down into the well, wherein the communication system is arranged so that at least part of a signal path for communications between the first and second locations is provided by the downhole metallic structure such that, in use, data to be communicated between the first and second locations is carried by electrical signals in the downhole metallic structure; and the communication system further comprises a noise cancellation arrangement arranged for sensing a noise signal generated in the out of hole metallic structure and arranged for applying a corresponding noise cancelling signal to the out of hole metallic structure or the downhole metallic structure to inhibit introduction of electrical noise into the downhole metallic structure from the riser.

According to another aspect of the present invention there is provided a downhole communication system for a subsea oil and/or gas well installation which installation comprises out of hole metallic structure comprising a riser running upwards away from the mudline, and downhole metallic structure running down into the well, the communication system comprising a downhole unit for location downhole in the subsea oil and/or gas well installation and a second unit, wherein the communication system is arranged to allow communication between the downhole unit and the second unit over a signal path at least part of which is provided by the downhole metallic structure such that, in use, data to be communicated between the downhole location and the second unit is carried by electrical signals in the downhole metallic structure; and the communication system further comprises a noise cancellation arrangement arranged for sensing a noise signal generated in the out of hole metallic structure and arranged for applying a corresponding noise cancelling signal to the above well head metallic structure or the downhole metallic structure to inhibit introduction of electrical noise into the downhole metallic structure from the riser.

Such systems can help ensure that the communication system can function effectively when the riser is present and tending to pick up noise and feed corresponding noise currents into the downhole metallic structure. This can be helpful, for example, during installation of downhole EM communication systems which are intended to be used in the longer term without the riser present. It simplifies commissioning and testing since this is possible whilst the riser is still in place and allows gathering of data whilst the riser is in place. It also helps communication in systems where a riser will be present long term.

The first location may be downhole. The second location may be downhole.

The second location may be at the surface. The second unit may be a surface unit.

Note that the "surface" as mentioned above may be the seabed/mudline in the subsea well and other locations above this locations where appropriate—such as a platform, say a vessel, to which the riser leads. Generally "surface" is used to refer to any convenient location for applying and/or picking up signals, which is outside of the borehole of the well. Note that in this specification the expressions "subsea" and "seabed" are used in the conventional sense in the oil and gas industry—that is they include reference to any body of water not just "sea". So subsea refers to any under water situation and seabed refers to the land surface below any body of water—ie this can be a river, lake or any other body of water not just "sea".

The out of hole metallic structure, may comprise seabed metallic structure, which may for example comprise a well head, and/or a Lower Marine Riser Package (LMRP). More generally this is any metallic structure of the installation at the seabed.

The surface unit may be installed at the well head. The surface unit may be installed at the seabed/mudline. The surface unit may comprise a seabed receiver, transmitter, or transceiver.

The out of hole metallic structure may further comprise riser support structure (which may be at the water surface) supporting the riser. The structure supporting the riser may, for example, comprise a platform, say a fixed platform, or a floating platform, i.e. a vessel, or parts thereof.

The noise cancelling signal may preferably be applied to the riser or the well head, or the LMRP.

Since the noise cancelling signals are applied to cancel signals in the riser, the riser cannot be sensibly used as part of a signal channel for transmitting electrical signals between the water surface and the seabed, unless say the signals used over this part of the channel were applied in a different frequency range than those downhole. However, of course besides using the riser as part of the signal channel, different options are available for extracting the signals from/applying signals to seabed level. Thus if there is a desire to communicate above the level of the seabed in the present communication systems another technique is likely to be used for this part of the signal path—for example a direct cable connection via an umbilical, or an acoustic link.

The noise cancelling arrangement may comprise a noise cancelling unit, which may be installed in the region of the seabed or may be installed part way along the riser or may be installed in the region of a vessel or other supporting structure.

The noise cancelling arrangement may comprise current sensing means for sensing noise current in the out of hole metallic structure. The noise cancelling arrangement may comprise an output electrically connected to or electrically connectable to the metallic structure of the well installation for applying the noise cancelling signal. The noise cancelling arrangement may be arranged to determine the noise cancelling signal in dependence on an output of the current sensing means.

The noise cancelling unit may comprise the current sensing means. The noise cancelling unit may comprise a signal output means for outputting the noise cancelling signal.

The current sensing means may comprise a differential amplifier. The noise cancelling arrangement may comprise current sensing means, which may comprise a differential amplifier, with a first input connected or connectable to the out of hole metallic structure, say the riser, or the well head when at the seabed, a second input connected or connectable to a reference location and an output connected or connectable to the out of hole metallic structure, say the riser, or the well head when at the seabed for applying a noise cancelling signal to the above well head metallic structure, say the riser, or the well head when at the seabed in dependence on potential difference detected between the inputs.

In other cases the current sensing means may comprise a non-contact sensing means for sensing the current in the metallic structure by say sensing electric and/or magnetic field in the region of the structure. The current sensing means might for example comprise a pick up coil such as a toroid, or a MEMS (Micro-Electro-Mechanical Systems) device.

In some embodiments the reference location may comprise a reference electrode, which could, say, be a seawater electrode or part of another well installation. In other embodiments the reference location may comprise a portion of the (main) well installation, say the riser when the first input is connected to the well head, and the well head or the riser when the first input is connected to the riser.

One of the following three connection options are currently preferred:

i) the first input is connected or connectable to the riser at a first location, the second input is connected or connectable to the riser at a second location spaced from the first and the output is connected or connectable to the riser at the first, second or another location;

ii) the first input is connected or connectable to the riser, the second input is connected or connectable to the well head, when at the seabed, and the output is connected or connectable to the riser;

iii) the first input is connected or connectable to the riser, the second input is connected or connectable to a reference electrode and the output is connected or connectable to the riser.

However it should be noted that there are other workable connection combinations, with say the output connected to the well head when at the seabed or at least one input or output connected to structure supporting the riser.

Further in a situation where the out of hole structure comprises a LMRP, connections may be made to this rather than to a seabed well head and/or the riser.

Option i) in principle can be used at any convenient position along the riser, but might most likely provided towards a midpoint of the riser.

Option ii) in practical terms is likely to be used for a seabed installation.

Option iii) is best used at some significant spacing from the seabed to ensure effective operation.

The current sensing means, say differential amplifier, may have a ground connected or connectable to a seawater electrode which is distinct from said reference location. This helps ensure effective noise cancellation by allowing the amplifier to operate around a desired zero point. Preferably the seawater electrode offers a low impedance path to earth and is well isolated from the connection points for the inputs to the differential amplifier as well as the well head, when present at the seabed, and riser in general to help maximise effectiveness of the noise cancellation.

The noise cancelling arrangement may be arranged to apply noise cancelling signals for cancelling noise signals over a predetermined frequency range.

The noise cancelling arrangement may comprise a filter for controlling the range of frequencies over which noise cancelling signals are applied to the out of hole metallic structure, say the riser or well head when at the seabed.

This can help ensure that noise is only cancelled in a range of frequencies which are of interest for communication in the communication system. Other currents, such as cathodic protection currents may then be allowed to flow without significant attenuation and energy need not be wasted in cancelling noise which has no significant effect on communication.

The noise cancelling arrangement may be arranged to apply non dc noise cancelling signals so as to leave cathodic protection currents substantially unaffected. The noise cancelling arrangement may be arranged to apply non dc noise cancelling signals. The noise cancelling arrangement may be arranged to apply noise cancelling signals in the range of 0.1 Hz to 10 Hz.

The filter may be arranged so as to avoid the application of dc noise cancelling signals.

The filter may be a low pass filter. The filter may be a band pass filter.

The filter may comprise a band pass filter arrangement. The band pass filter arrangement may comprise a low pass filter and a second element to provide a lower end frequency cut-off. Alternatively the band pass filter arrangement may comprise a band pass filter. The filter may be arranged to have a passband of 0.1 Hz to 10 Hz.

More generally the frequency range of the noise cancelling signals and/or filter passband may have an upper limit determined in dependence on the frequencies used in the communication system and a lower limit determined in dependence on the frequencies used in the communication system and whether there is a need to allow cathodic protection currents to flow.

The differential amplifier may comprise the filter.

The differential amplifier may comprise a pre-amplifier with inputs that act as inputs to the differential amplifier and an output connected to an input of a power amplifier, the output of which power amplifier acts as an output of the differential amplifier.

The filter or at least a part of the filter may be connected between the output of the pre-amplifier and the input of the power amplifier. This allows an arrangement such that signals outside of the passband of the filter are not amplified by the power amplifier.

Where the filter comprises a band pass filter arrangement comprising a low pass filter and another element, the low pass filter may be connected between the output of the pre-amplifier and the input of the power amplifier.

There are alternatives for installation of the noise cancelling arrangement, for example the noise cancelling arrangement may be deployed with the riser, the noise cancelling arrangement may be retrofitted to the riser, the noise cancelling arrangement may be retrofitted at the seabed.

Where the noise cancelling arrangement is retrofitted at the seabed, and at least one physical connection is made to the riser for sensing noise signals and/or applying the noise cancelling signals, said at least one physical connection may comprise a snatch disconnector to allow disconnection should the riser need to be removed in an emergency shut down.

Where the noise cancelling arrangement is retrofitted at the seabed, the noise cancelling unit of the noise cancelling arrangement may be housed in a seabed basket.

Where the noise cancelling arrangement is provided on the riser, the noise cancelling unit of the noise cancelling arrangement may be mounted to a riser section in a clamshell arrangement. This can facilitate retrofit installation. To ease installation and to reduce components, the clamshell arrangement may incorporate the seawater electrode.

According to a further aspect of the present invention there is provided a riser noise cancelling arrangement for use in a downhole communication system as defined above, the noise cancelling arrangement comprising a current sensing means with a first input connectable to out of hole metallic structure, say the riser, or the well head when present at the seabed, a second input connectable to a reference location and an output connectable to out of hole metallic structure, say the riser, or the well head when present at the seabed for applying a noise cancelling signal to the riser in dependence on potential differences detected between the inputs.

According to a further aspect of the present invention there is provided a method of installing a noise cancelling arrangement for use in a downhole communication system as defined above, which method comprises one of deploying the noise cancelling arrangement with the riser, retrofitting the noise cancelling arrangement to the riser, and retrofitting the noise cancelling arrangement to the riser at the seabed.

According to a further aspect of the present invention there is provided a downhole communication method for communication between a downhole location in an subsea oil and/or gas well installation and a second location, the oil and/or gas well installation comprising out of hole metallic structure comprising a riser running upwards away from the mudline and downhole metallic structure running down into the well, the communication method comprising the steps of:

using the downhole metallic structure as at least part of a signal path for communications between the downhole location and the second location so that data to be communicated between the downhole location and the second location is carried by electrical signals in the downhole metallic structure; and sensing a noise signal generated in the out of hole metallic structure and applying a corresponding noise cancelling signal to the out of hole metallic structure or the downhole metallic structure to inhibit introduction of electrical noise into the downhole metallic structure from the riser.

The out of hole metallic structure may further comprise support structure for supporting the riser.

The downhole communication arrangement may further comprise a noise suppression arrangement arranged for diverting a noise signal generated in the out of hole metallic structure away from the downhole metallic structure, the suppression arrangement comprising at least one seawater electrode electrically connected to the out of hole metallic structure or the downhole metallic structure to create a current flow path to ground via the at least one electrode, wherein the current flow path has an impedance, at the frequency of said electrical signals, which is no larger than 1/10th of the impedance to ground that would be seen at the frequency of said electrical signals from an upper end of the riser via the riser and downhole metallic structure in the absence of the suppression arrangement.

According to another aspect of the present invention there is provided a downhole communication system for communication between a first and second location in a subsea oil and/or gas well installation, the oil and/or gas well installation comprising: out of hole metallic structure comprising a riser running upwards away from the mudline, and downhole metallic structure running down into the well, wherein the communication system is arranged so that at least part of a signal path for communications between the first and second locations is provided by the downhole metallic structure such that, in use, data to be communicated between the first and second locations is carried by electrical signals in the downhole metallic structure; and the communication system further comprises a noise suppression arrangement arranged for diverting a noise signal generated in the out of hole metallic structure away from the downhole metallic structure, the suppression arrangement comprising at least one seawater electrode electrically connected to the out of hole metallic structure or the downhole metallic structure to create a current flow path to ground via the at least one electrode, wherein the current flow path has an impedance, at the frequency of said electrical signals, which is no larger than 1/10th of the impedance to ground that would be seen at the frequency of said electrical signals from an upper end of the riser via the riser and downhole metallic structure in the absence of the suppression arrangement.

This can help divert a significant proportion of noise current, at the frequencies of interest, out of the riser and downhole metallic structure from the point(s) at which the electrode(s) are connected to the structure. The smaller the impedance the greater the portion of the noise that can be led away. With the impedance at 1/10th of the via structure impedance, the noise current may be reduced by say 20 dB.

There may be a plurality of seawater electrodes. There may be a plurality of connection points to the out of hole metallic structure. A plurality of electrodes may be connected to one connection point. Any one electrode may be connected to one or a plurality of connection points. Thus the current flow path may include one or more electrode and one or more connections to the or each electrode.

It will be appreciated that if plural electrodes are provided and/or plural connections to the out of hole metallic structure are made these will act together in parallel, giving an overall or aggregate impedance to ground, and in such a case it is to the overall impedance that the above statements of invention refer and which is to be compared to the impedance via the structure.

The noise suppression arrangement may comprise at least one filter for controlling the range of frequencies which are led to ground via the at least one electrode. The filter may comprise a high pass filter. A decoupling capacitor may be provided in the current flow path such the cathodic protection currents are not led away to ground via the electrodes.

Note that the impedance to ground given in such arrangements will be much smaller than that provided in a conventional situation via eg cathodic protection anodes. A cathodic protection anode might have a surface area of say 0.5 $m^2$ whereas to be effective in the above type of noise suppression arrangement the surface area of the electrode or the aggregate area of the electrodes will typically be many 10s of square metres or more.

The at least one sea water electrode may have an aggregate surface area of at least 100 $m^2$. Thus there might be one electrode with an area which is equal to or exceeds 100 $m^2$ or a plurality of electrodes the combined surface area of which equals or exceeds 100 $m^2$.

In some cases the at least one electrode may comprise an outer insulating layer. This may be in the form of a coating applied to the electrode or an oxide layer. This can serve to inhibit the flow of (dc) cathodic protection currents, so as to not upset cathodic protection, whilst allowing noise suppression. The electrode might be of stainless steel.

In another example a large array of (sacrificial—if there is no dc de-coupling) cathodic protection anodes—say 200—might provide adequate noise suppression, but providing this number of anodes is likely to be impractical.

The downhole communication system may comprise at least one noise cancellation arrangement and at least one passive noise suppression arrangement. In such a case at least one noise cancellation arrangement may be provided to apply a noise cancellation signal to the metallic structure at a location below the connection point of the at least one passive suppression arrangement.

According to another aspect of the present invention there is provided a downhole communication system for communication between a first and second location in a subsea oil and/or gas well installation, the oil and/or gas well installation comprising: metallic structure comprising out of hole metallic structure comprising a riser running upwards away from the mudline, and downhole metallic structure running down into the well, wherein the communication system is arranged so that at least part of a signal path for communications between the first and second locations is provided by the downhole metallic structure such that, in use, data to be communicated between the first and second locations is carried by electrical signals in the downhole metallic structure; and the communication system further comprises a noise suppression system for suppressing introduction, into the downhole metallic structure, of a noise signal generated in the out of hole metallic structure, the suppression system comprising an electrical connection between a contact point on the metallic structure and a remote ground, and being arranged to cause or allow a corresponding noise suppression current to flow in said electrical connection so as to inhibit flow of noise current in the metallic structure below the contact point.

The noise suppression system may comprise a noise cancelling arrangement as defined above (ie with active cancelling) and/or a passive noise suppression arrangement as defined above.

According to another aspect of the invention there is provided a subsea oil and/or gas well installation, the oil and/or gas well installation comprising out of hole metallic structure comprising a riser running upwards away from the mudline and downhole metallic structure running down into the well and a communication system as defined above.

Note that in general each of the optional features following each of the aspects of the invention above is equally applicable as an optional feature in respect of each of the other aspects of the invention and could be re-written after each aspect with any necessary changes in wording. Not all such optional features are re-written after each aspect merely in the interests of brevity.

Embodiments of the present invention will now be described, by way of example only, with reference to the accompanying drawings in which:

FIG. 1 schematically shows a well installation including a communication system for communication between a downhole location in the subsea oil and/or gas installation and the surface;

FIG. 2 schematically shows part of the communication system shown in FIG. 1 with a first noise cancellation arrangement shown in more detail;

Figure 1:
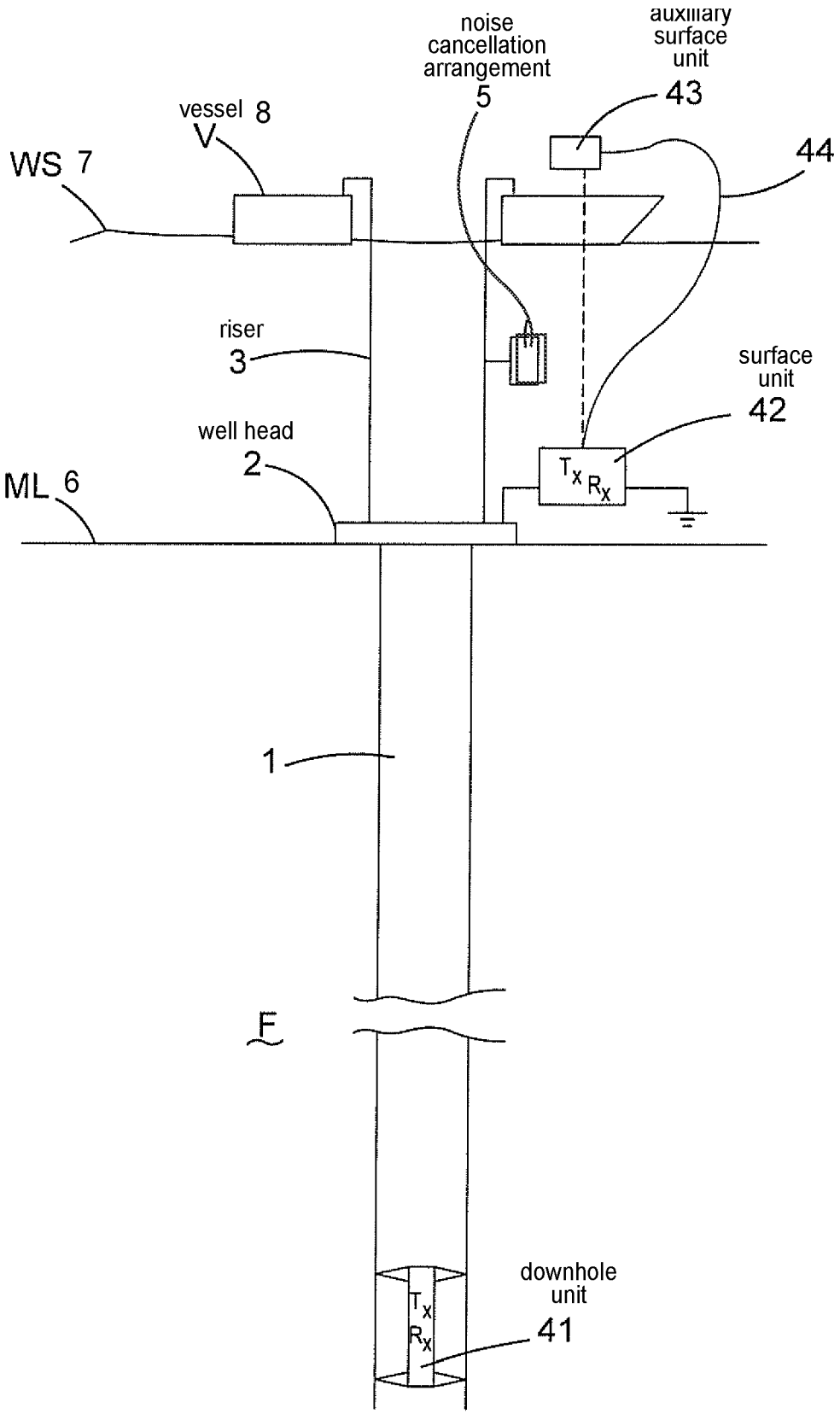
Figure 9:
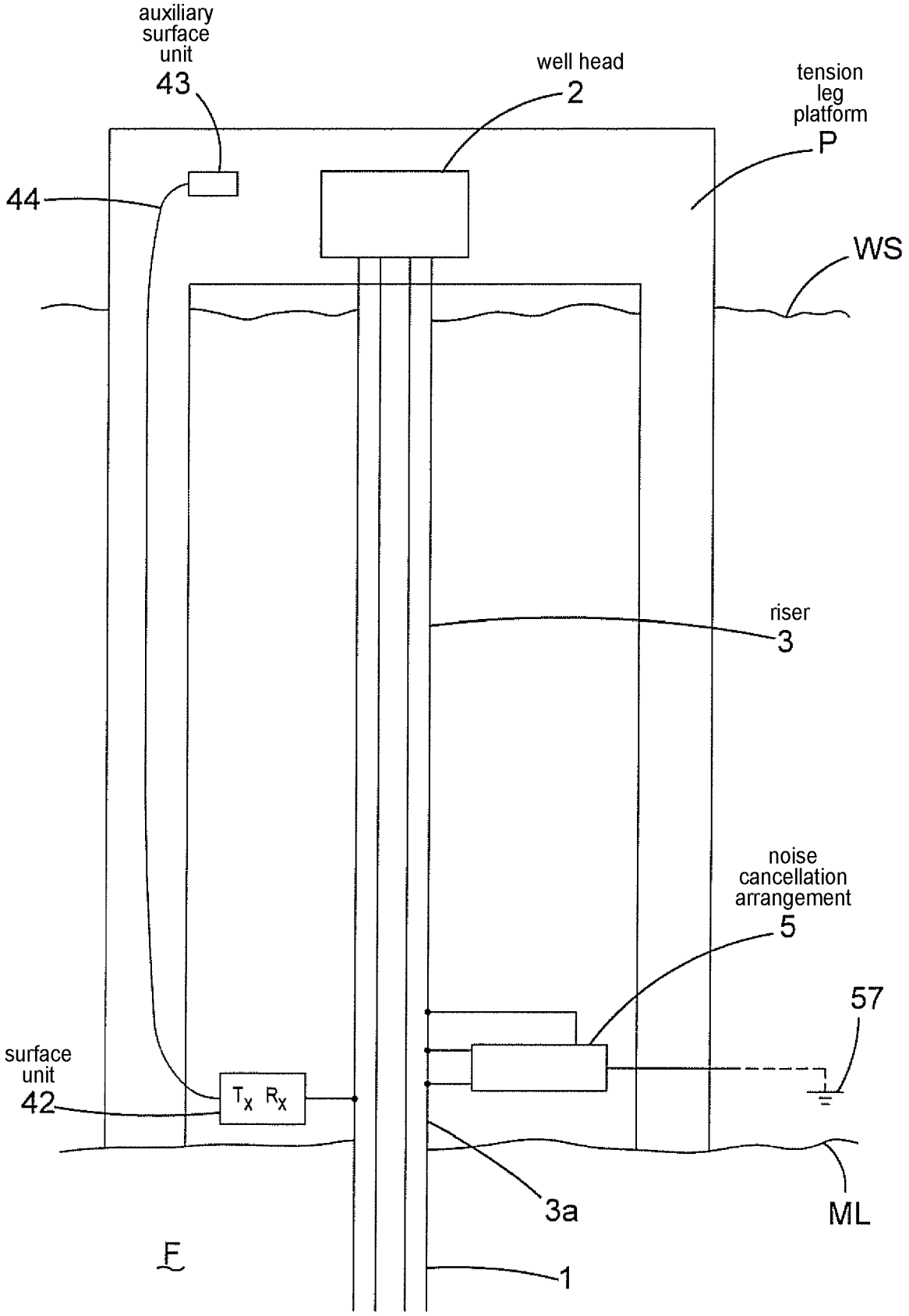
Figure 10:
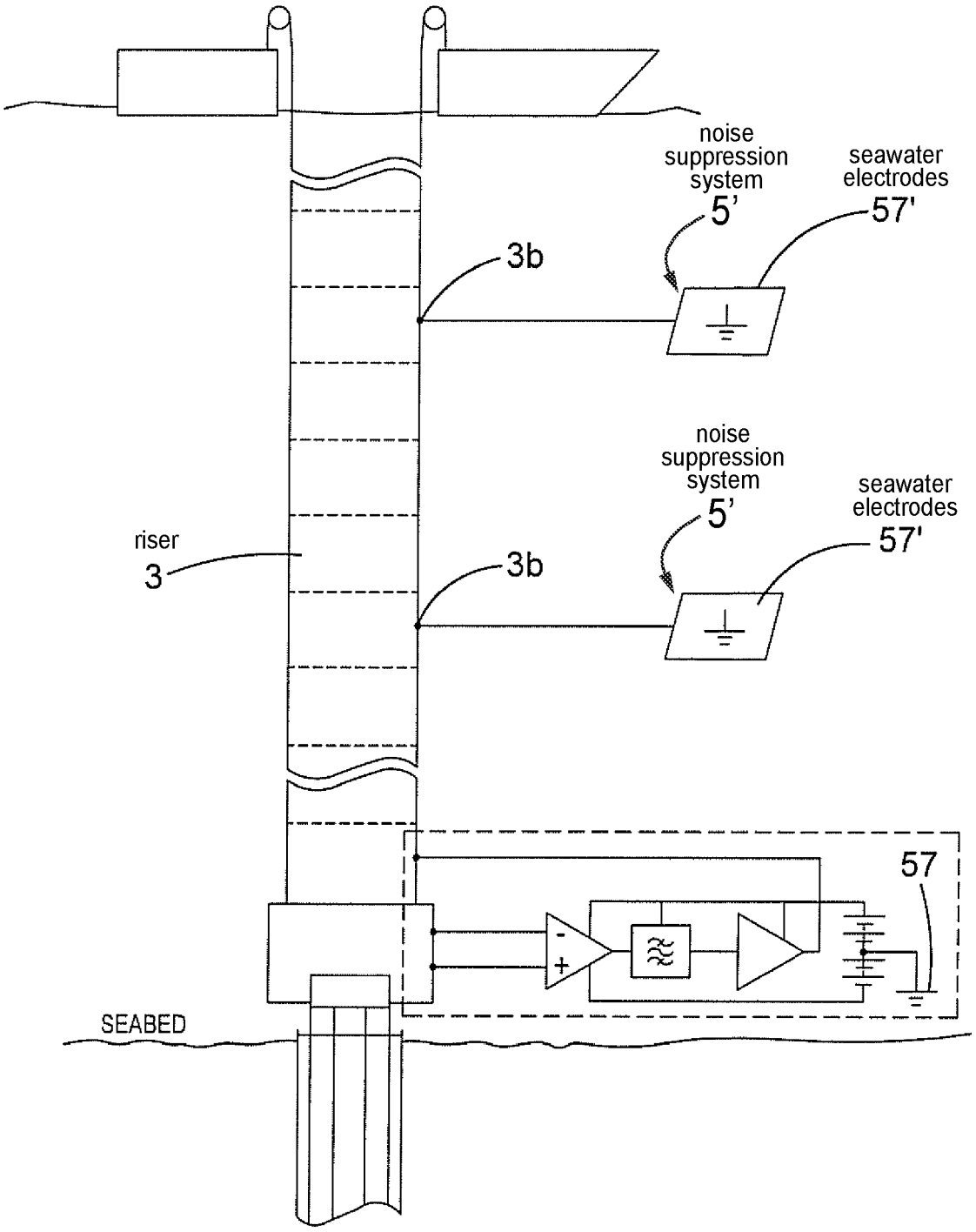

FIG. 9 schematically shows an alternative type of well installation including a communication system and a noise cancellation arrangement; and FIG. 10 shows part of a well installation of the type shown in FIG. 1 including an alternative noise suppression arrangement.

FIG. 1 shows a subsea oil and/or gas well installation including a communication system for communication between a downhole location in the borehole of the well and the surface—in this instance first of all the seabed/mudline ML 6 and second the water surface WS 7.

The well installation comprises downhole metallic structure 1 leading down into the borehole in the formation F. It will be appreciated that the downhole structure 1 is shown only in highly schematic form in FIG. 1. In reality the downhole metallic structure will comprise multiple runs of metallic tubing arranged as liner, casing, production tubing and so on as appropriate.

A well head 2 is provided at the seabed or mudline ML 6. Further in the situation shown in FIG. 1 a riser 3 is present and connected to the well head 2. The riser 3 leads through the water (typically seawater) to the water surface WS 7. At the water surface WS 7, the riser 3 meets with an appropriate supporting vessel V 8 or other supporting structures—together with the riser 3 these can be considered to constitute out of hole metallic structure. The out of hole metallic structure may comprise other components such as a slip joint (not shown) and/or compensation rams (not shown) for supporting the riser 3. Further a Lower Marine Riser Package (LMRP) (not shown) may be provided at the well head 2 via which the riser 3 is connected to the well head 2.

In the present well installation the communication system comprises a downhole unit 41, a surface or seabed unit 42, and an auxiliary surface unit 43 provided on the vessel V.

The downhole unit 41 is arranged for applying electrical data carrying signals to the downhole metallic structure 1 such that these may be transmitted up the downhole metallic structure 1 and through the well head 2. The exact mechanism for injecting the data carrying signals onto the downhole metallic structure 1 is not of particular interest to the present ideas but, for example, these signals may be injected making use of spaced contacts at the downhole unit 41 which allow the downhole communication unit 41 to act as a dipole. Such communication units are commercially available, for example, from the applicant. It will be appreciated that different devices at different locations, including the use of repeater stations at appropriate locations may be used as downhole communication units in addition to or in alternative to the type of downhole unit 41 shown. Thus say, there may be communication with one or more lateral bore and the surface.

At the well head 2 the surface unit 42 is able to detect the signals by virtue of monitoring the potential difference between the well head 2 and ground. In alternatives, different connection points could be used. For example, the surface unit 42 could be connected between the riser 3 and ground. Further where mention is made of connecting to the well head then, when present the connections might be made to the LMRP. Similarly in other types of installation the well head may be on a platform, i.e. at a well head deck, such that connections near the seabed are made to the metallic structure of the riser as this leaves the bore hole or any other appropriate structure at that region.

Signals may then be communicated from the surface unit 42 to the auxiliary surface unit 43 via convenient means. For example, a cable connection 44 might be provided or signals may be transmitted over an acoustic link.

As well as communicating signals from the downhole unit 41 towards the surface, signals may also be transmitted in the opposite direction. That is to say data which it is desired to send from the auxiliary surface unit 43 or surface unit 42 may be transmitted down the metallic structure 1 and picked up at the downhole communication unit 41.

In the present techniques it is useful if the communication signals are applied and/or picked up by, respectively the application of, and detection of, potential difference between appropriately spaced locations. This helps ensure that communication is not compromised by the noise cancelling techniques.

Similarly there may be communication between two spaced downhole locations without the signals necessarily being sent from or received at the surface. Control signals say may be sent from a downhole central unit to a downhole actuator.

So far the communication arrangements described above are known and known to function effectively when a riser 3 is not connected to the well head 2. However, as mentioned in the introduction, when a riser 3 is connected to the well head 2, it becomes a significant source of noise which is then injected into the well head 2 and downhole metallic structure 1. In turn this can render signals sent by the downhole communication unit 41 undetectable by the surface unit 42. Similarly signals sent in the other direction can be adversely affected as can signals which are sent and received between two downhole locations. Thus, in the present communication system a noise cancellation arrangement 5 is provided to help counter the presence of the riser 3 and allow the effective detection of signals at the surface unit 42. As will be appreciated the noise cancellation system can also assist in the detection of signals downhole, including signals sent between two downhole locations.

Figure 2:
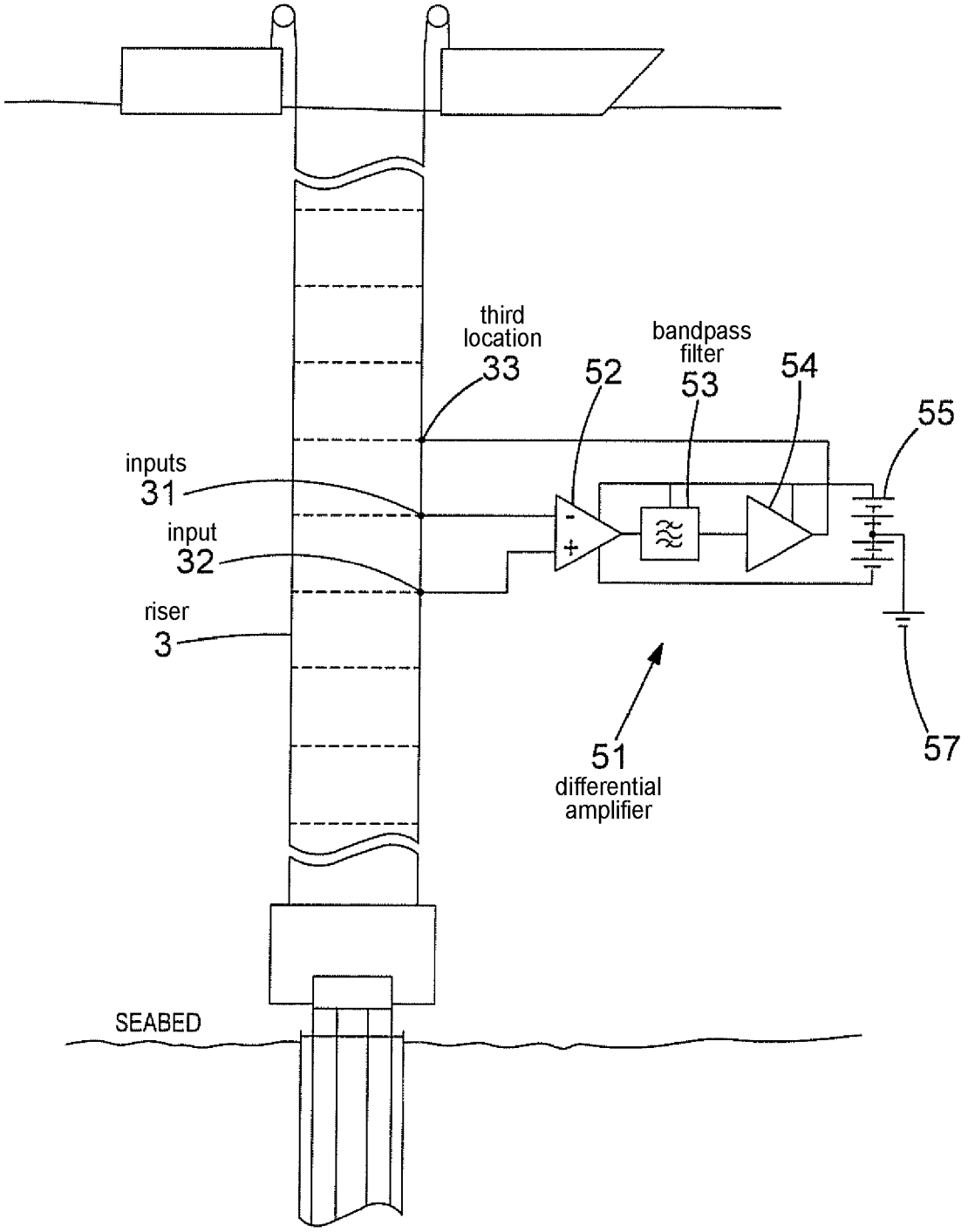

Different implementations of the noise cancellation arrangement 5 are envisaged and a first of these is shown in FIG. 2.

FIG. 2 shows part of the well installation shown in FIG. 1 but with various parts omitted for clarity. Here the noise cancellation arrangement 5 comprises current sensing means in the form of a differential amplifier 51 which has its inputs connected to the riser 3 at two spaced locations 31, 32 and its output also connected to the riser 3 at a third location 33.

In alternatives however it should be noted that the output of the differential amplifier 51 may be connected to the riser 3 at the same location as one of the inputs 31, 32 if desired.

The differential amplifier 51 also has its ground connected to a separate seawater electrode 57 which is remote from the riser 3 and remote from the metallic structure of the well installation in general. This serves to ensure that the differential amplifier 51 is able to operate around the desired zero point.

The differential amplifier 51 comprises an input pre-amplifier 52 having one of its inputs connected to the riser at the first connection point 31 and its other input connected to the riser at the second connection point 32. Thus the input pre-amplifier 52 is arranged for detecting noise in the riser 3 due to differences seen between its inputs. The output of the pre-amplifier 52 is connected via a band pass filter 53 to a power amplifier 54. The output of the power amplifier 54 is connected to the third connection point 33 on the riser 3 and acts as the output of the differential amplifier 51.

Batteries 55 are provided in the present noise cancellation arrangement as a power source.

The power amplifier 54 serves to amplify the output of the input pre-amplifier 52 so as to apply a noise cancelling signal to the riser 3 via the third connection point 33 based on the noise signal detected by the input pre-amplifier 52.

The band pass filter 53 is arranged to have a passband which corresponds to a frequency range over which it is desired to cancel noise signals. In the present embodiment the passband of the band pass filter 53 is 0.1 Hz to 10 Hz. This passband is chosen so that cathodic protection currents flowing in the riser are left unaffected whilst noise signals at frequencies which are used in the communication system between the downhole unit 41 and the surface unit 42 are cancelled. By filtering over this range, and cancelling noise only in the frequency range of interest, energy can be saved.

As will be explained in more detail below, other band pass filter arrangements may be used. For example a low pass filter may be provided separately from a high pass filter to give band pass functionality. A low pass filter may be provided in place of the band pass filter 53 and a high pass filter provided at the input to the differential amplifier say, in the form of a transformer arrangement or as series capacitor. Alternatively, a dc restoration circuit may be used.

The current sensing means, i.e. in this case, the differential amplifier 51 including the batteries 55 may be housed in a noise cancellation unit which can be mounted to the riser 3 at an appropriate location in, for example, a clam shell mounted housing.

With the first noise cancellation arrangement shown in FIG. 2, in principle the connections to the riser 3 and the noise cancellation unit may be positioned at any convenient location along the length of the riser. Typically, however, a location towards a mid-point of the riser 3 may be chosen. It is desirable to have the connection points to the riser 3 at a sufficient depth below the surface of the water such that the screening effect of the water tends to cancel out noise being delivered to the riser other than down the riser itself. Thus the connection points and noise cancellation unit may preferably be disposed at least 300 meters below the water surface. In less preferred alternatives one or more connection may be made to the vessel V or other parts of the above well head metallic structure—such an example is described in more detail further below.

When the noise cancellation arrangement is in operation, the output of the noise cancellation arrangement, that is, the output of the differential amplifier 51 acts as a third connection in which current can flow relative to a "node" that can be considered to exist at the point where the output of the differential amplifier 51 is galvanically connected to the metallic structure. According to Kirchhoff's current law the sum of currents flowing into a circuit node is zero. Thus the sum of the currents flowing down the riser 3 to the connections point, up the metallic structure to the connection point, and into the connection point from the output of the noise cancellation arrangement 5 sum to zero.

Thus the aim in the present systems is to arrange the current flow in the output of the noise cancellation circuit to be equal in magnitude to that flowing in the portion of the out of hole structure above the connection point such that none of the signal from the portion of the out of hole structure above the connection point is seen below the connection point. The noise signal can be considered diverted into the third connection where appropriate currents flow through the cancellation arrangement to ground via the seawater electrode 57 (or vice versa depending on the instantaneous sign of the signal).

In practice of course perfect cancellation is unlikely to be achieved. Thus with the present system the current flow in the output of the noise cancellation circuit may be substantially equal in magnitude to that flowing in the portion of the out of hole structure above the connection point, or tend towards being equal in magnitude.

Figure 3:
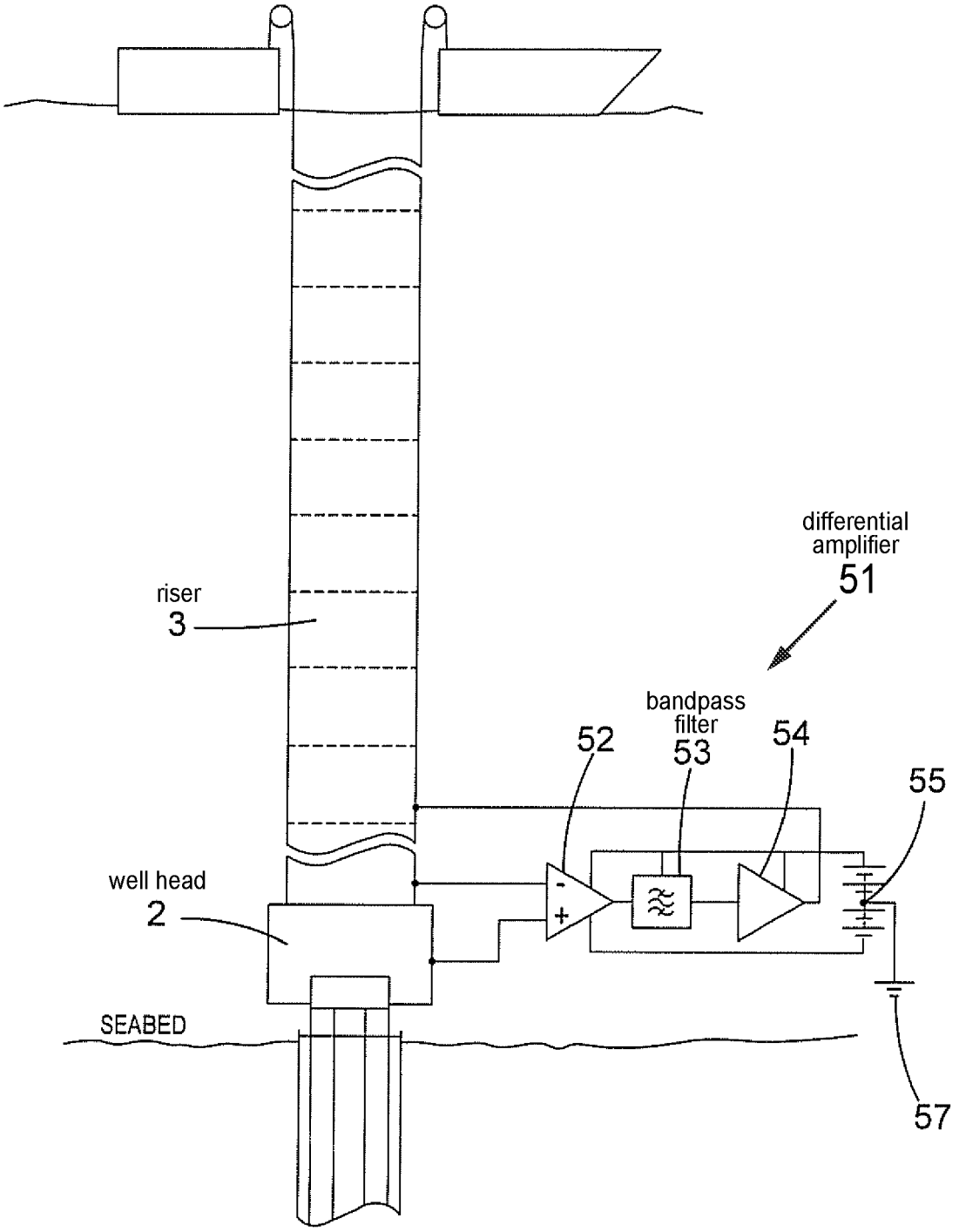
FIG. 3 shows part of a well installation of the type shown in FIG. 1 including a second noise cancellation arrangement.

FIG. 3 shows a well installation similar to that shown in FIG. 2 but with an alternative, second noise cancellation arrangement 5. Here again the noise cancellation arrangement 5 comprises a differential amplifier 51 having basically the same arrangement as that shown in FIG. 2. However, here one of the inputs to the differential amplifier 51 and hence one of the inputs of the input pre-amplifier 52 is connected to the well head 2 rather than the riser 3. Note that the connection might be made to the LMRP rather than the well head 2 when a LMRP is present. Similarly if there is no seabed well head the connection might be directly to the metallic structure as this leaves the borehole i.e. at the foot of the riser or to any other appropriate metallic structure at that region.

Thus in this case, the noise cancellation arrangement is arranged nearer to the mudline/seabed ML, and well head 2. In this instance the noise cancellation arrangement 5 may comprise a noise cancellation unit which is housed in a seabed basket, disposed on the seabed. Further the connections between the differential amplifier 51 and the riser 3 are made by one or more snatch connectors so that the noise cancellation unit may be disconnected from the riser 3 should this need to be guillotined off and removed in an emergency.

Figure 4:
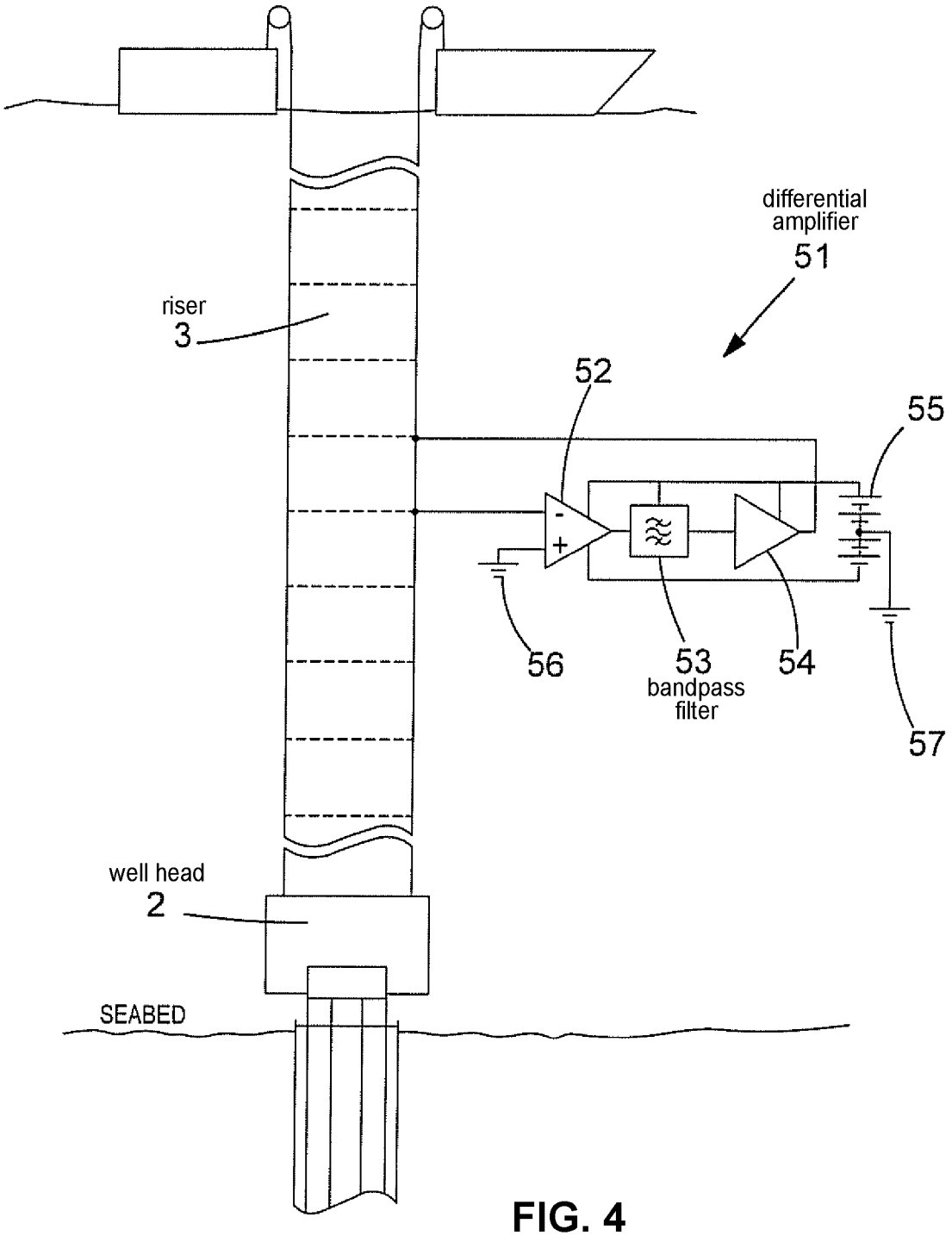
FIG. 4 shows part of a well installation of the type shown in FIG. 1 including a third noise cancellation arrangement.

FIG. 4 shows another well installation which is similar to that shown in FIGS. 2 and 3 and which again has a noise cancellation arrangement which is similar to that shown in FIGS. 2 and 3. Here the third noise cancellation arrangement again comprises a differential amplifier arranged as is the differential amplifier in FIGS. 2 and 3. In this case, however, one of the inputs into the differential amplifier 51 and hence one of the inputs of the pre-amplifier 52 is connected to a reference electrode 56 rather than to the riser 3 or well head 2. This reference electrode 56 should be separate from the seawater electrode 57 and be well spaced and isolated both from the seawater electrode 57 and the riser 3 and well head 2. At least in principle, the reference electrode 56 might be part of an adjacent well installation. The differential amplifier in the arrangement in FIG. 4 operates on a similar principle to that in FIG. 2 and in FIG. 3. However it is arranged for detecting noise signals in the riser 3 by reference to an earth (provided by electrode 56) rather than by detecting the potential difference between two locations on the metallic structure of the well installation itself.

It will be clear that the reference electrode 56 is separate from and for providing a different function from the seawater electrode 57. Whilst in theory these electrodes could be connected together in some way, this is not the intention and very much not preferred. The reference electrode 56 is there to provide a voltage reference with no or minimal current flowing. On the other hand the seawater electrode 57 is a ground return for the amplifier which will have the noise cancellation current flowing through it. Thus the seawater electrode 57 will tend not to be at ground potential due to impedance to earth. If the seawater electrode 57 was very large and thus had very low impedance to earth it would become more tolerable to have one structure acting as both the reference electrode 56 and the seawater electrode 57.

The arrangement shown in FIG. 4 functions most effectively with the noise cancelling unit and connections spaced away from the wellhead 2/seabed. Thus again this arrangement might be used towards the mid point of the riser 3. Again in a less preferred alternative one or more connection might be made to the vessel V or other parts of the above well head metallic structure.

Figure 5:
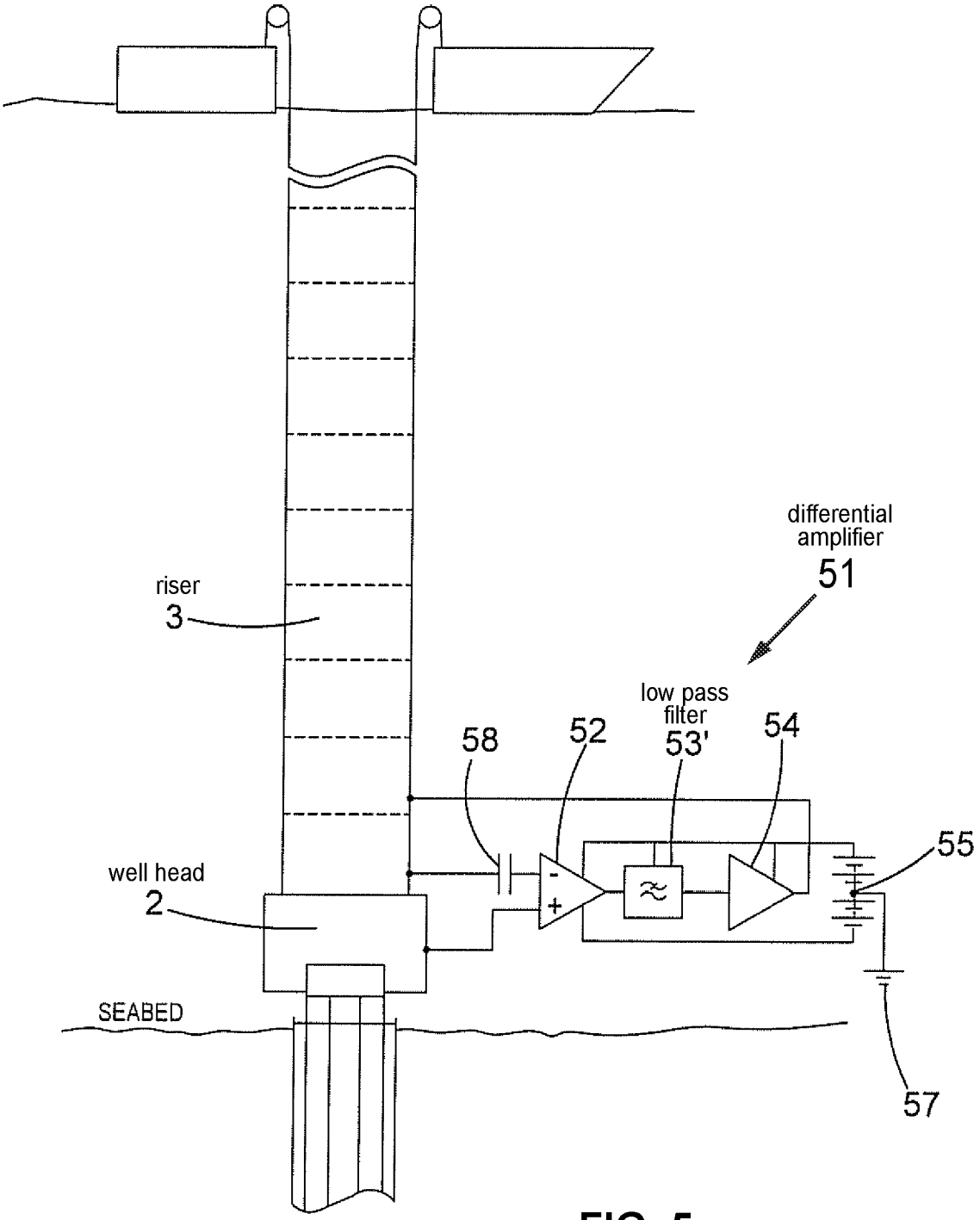
FIG. 5 shows part of a well installation of the type shown in FIG. 1 including a modified form of the second noise cancellation arrangement of FIG. 3.

FIG. 5 shows another well installation which is similar to that shown in FIGS. 2 to 4 which includes a modified form of the noise cancellation arrangement which is shown in FIG. 3. The difference lies in the differential amplifier 51.

This modified form of differential amplifier 51 could be used in any of the above noise cancellation arrangements.

In this case the differential amplifier comprises a low pass filter 53' in place of the band pass filter 53 of the arrangement in FIG. 3 and an input series capacitor 58 provided on one of the inputs to the differential amplifier 51 to act as a high pass filter. Together the low pass filter 53' and input capacitor 58 act as a band pass filter arrangement giving the same benefits mentioned above in relation to the band pass filter 53. However this construction may be more convenient to implement in at least some cases.

As will be seen, in this case the input capacitor 58 is provided in series between one input to the differential amplifier 51 and the remainder of the differential amplifier. Hence the capacitor 58 is connected in series between one input of the pre-amplifier 52 and the respective connection point to the metallic structure 2,3 of the well.

Figure 6:
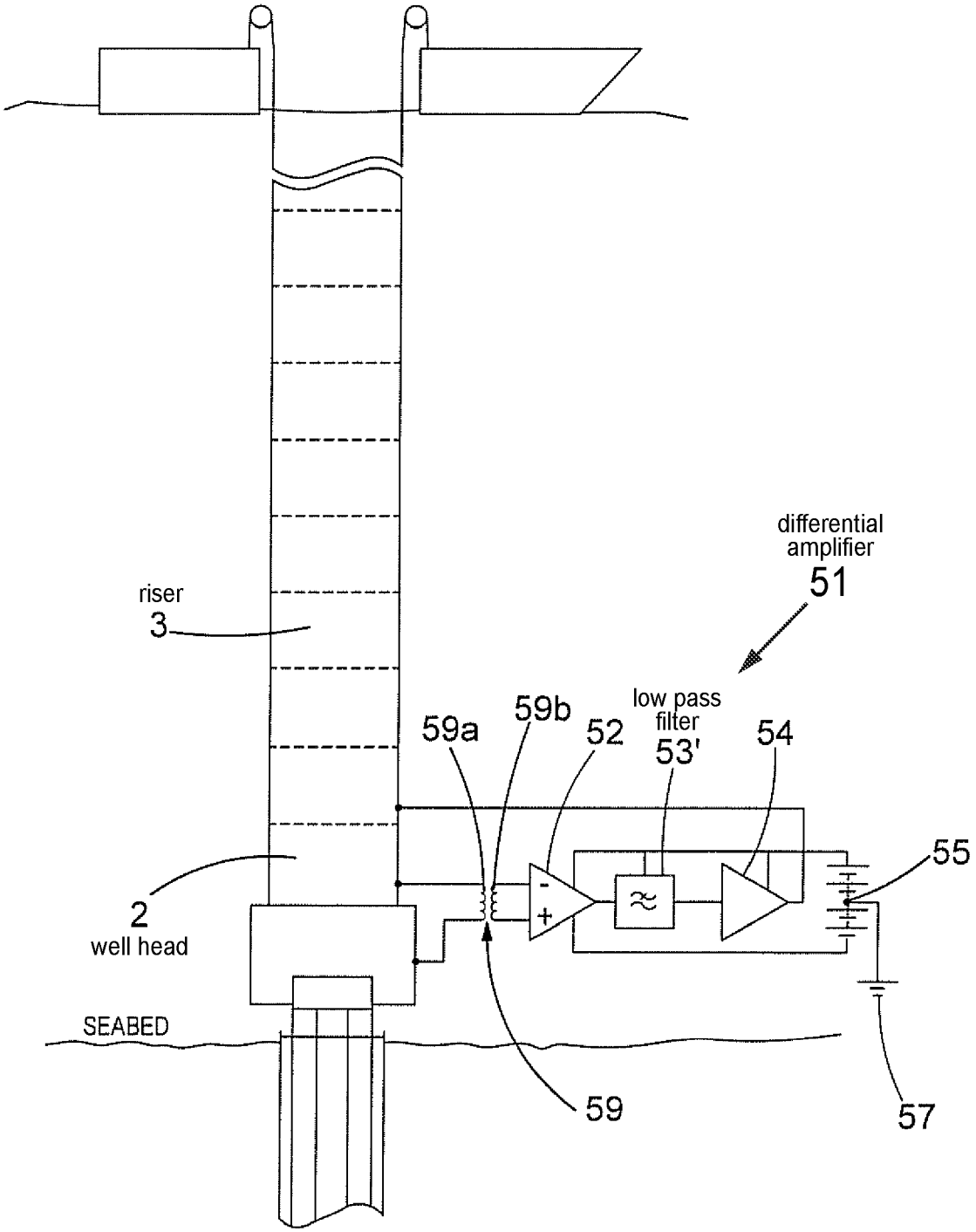
FIG. 6 shows part of a well installation of the type shown in FIG. 1 including another modified form of the second noise cancellation arrangement of FIG. 3.

FIG. 6 shows another well installation which is similar to that shown in FIGS. 2 to 5 which includes another modified form of the noise cancellation arrangement which is shown in FIG. 3. The difference again lies in the differential amplifier 51. This second modified form of differential amplifier 51 could again be used in any of the above noise cancellation arrangements.

In this case the differential amplifier comprises a low pass filter 53' in place of the band pass filter 53 of the arrangement in FIG. 3 and an input transformer 59 provided at the inputs to the differential amplifier 51 to act as a high pass filter. Together the low pass filter 53' and input transformer 59 act as a band pass filter arrangement giving the same benefits mentioned above in relation to the band pass filter 53. However this construction may be more convenient to implement in at least some cases.

As will be seen, in this case the input transformer 59 has a first winding 59*a* (for connection to, and in FIG. 6) connected to the respective locations on the metallic structure 2,3 of the well and a second winding 59*b* acting as an input to the remainder of the differential amplifier 51, specifically in this case the second winding 59*b* is connected to the inputs of the pre-amplifier 52.

The transformer 59 decouples the differential amplifier 51 from the metallic structure as far as dc signals (ie non-time varying signals) are concerned. Similar complete dc decoupling could also be achieved using a respective series capacitor on each input of the differential amplifier 51.

That said it will also be appreciated that filtering (high, low, band) is not essential and one or more aspect of filtering can be omitted if desired.

Figure 7:
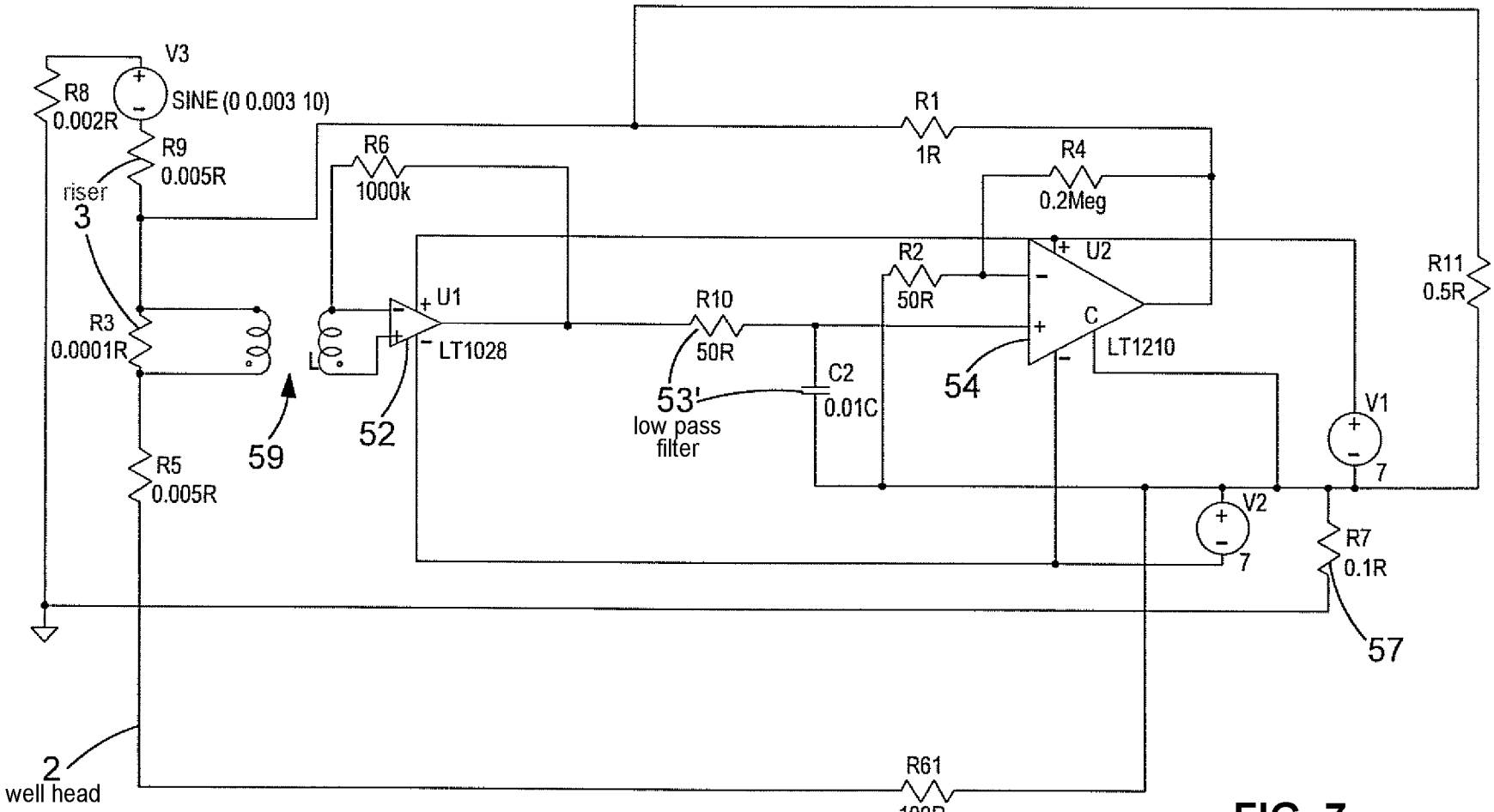
FIG. 7 is a circuit diagram showing, in more detail, the electrical arrangement of a noise cancellation arrangement of the type shown in FIG. 6 connected to the metallic structure of the well installation.

FIG. 7 is a circuit diagram showing more detail of the differential amplifier 51 described above in an implementation of the type shown in FIG. 6 combined with equivalent circuit components showing the metallic structure of the well installation and the surrounding environment. The same reference numerals are used in FIG. 5 to indicate the corresponding features as shown in the other Figures.

Note that at least with the arrangement of FIGS. 3, 5 and 6 the noise cancelling signal applied by the differential amplifier may tend to inject currents into the well head 2 that tend to cancel current representing the desired received signal. However, this is not problematic, and in fact can tend to enhance detection of signals. This is because the surface unit 42 is arranged to detect potential difference relative to ground. It is not detecting current. Thus if the noise cancellation arrangement achieves zero current flow at the wellhead 2 this will actually give increased potential difference relative to ground for the received signals compared to allowing the signal current to flow away to the riser/ground with no applied cancelling signal. The voltage of the received signal will not be divided (by a voltage divider) between the downhole structure signal channel and the path to earth, but rather all appear across the downhole structure signal channel—which is being measured.

Figure 8:
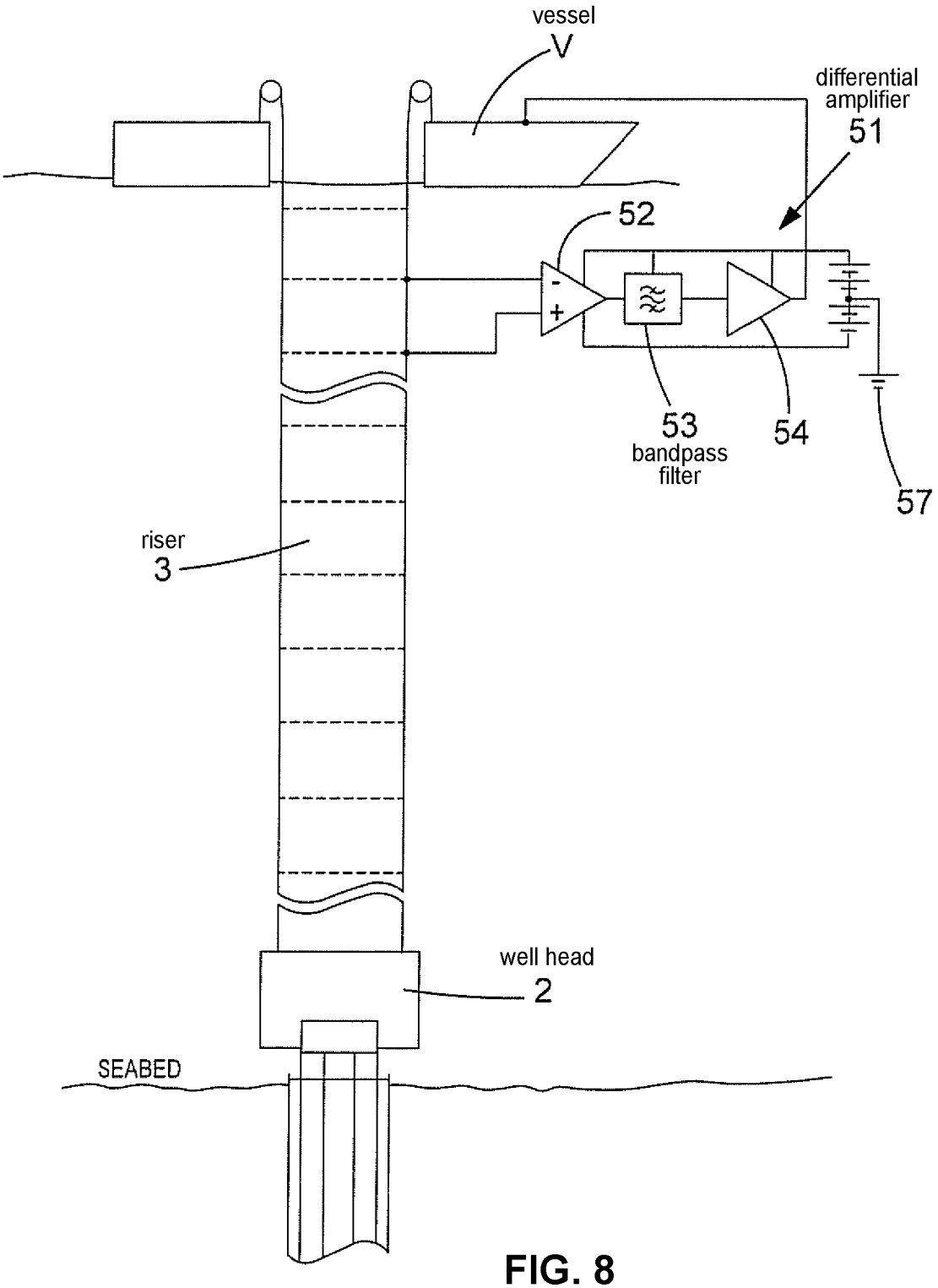
FIG. 8 shows part of a well installation of the type shown in FIG. 1 with an alternative noise cancellation arrangement.

FIG. 8 shows another well installation which is similar to that shown in FIG. 2 and includes a noise cancellation arrangement which is similar to that shown in FIG. 2. The difference resides in the fact that the output of the noise cancellation arrangement is connected to the vessel V rather the riser 3. Otherwise the structure and operation is as described above and the different options described above for implementations of the noise cancelling arrangement are also applicable here. In general the arrangement of FIG. 8 is less preferred since noise may be injected into the system, in particular into the riser, below the noise cancellation system so cancelling will tend to be less effective. However, useful results can still be achieved. In alternatives more or others of the connections may be made to the vessel V, or indeed other parts of the above well head metallic structure besides the riser 3, if desired. For example connections might be made to a slip joint (not shown) or heave compensation rams (not shown) supporting the riser 3. As another particular example an arrangement similar to that in FIG. 2 might be used near the surface with the output of the differential amplifier connected to a first point on the vessel, the inverting input connected to a second point on the vessel and the non-inverting input connected to the riser.

When the noise cancellation arrangement is situated conveniently relative to a source of mains power then mains power may be used in place of the batteries 55 shown in the cancellation arrangement above. Thus, for example, if the noise arrangement is close to the vessel, mains power from the vessel may be used. Thus say in the installation shown in FIG. 8 mains power may be used instead of batteries in the noise cancellation arrangement.

In a further alternative two cancellation arrangements may be used together on one well installation, and thus say there may be two cancellation units provided at different locations. In a particular example, a first cancellation arrangement as shown in FIG. 8 may be provided with a noise cancellation signal being applied to the above well head structure in the region of vessel V and a second cancellation arrangement as described in relation to any one of FIGS. 2 to 7 may be provided for applying a noise cancelling signal at a location below that at which the cancellation signal from the first cancellation arrangement is applied, such as on a mid or lower portion of the riser or at the well head.

More generally the system may comprise two cancellation arrangements used together on one well installation with a first cancellation arrangement for applying a first noise cancellation signal to the out of hole structure at a first location and a second cancellation arrangement for applying a second noise cancellation signal to the out of hole structure or the downhole structure at a second location which is spaced from the first location. The first and second locations will typically be chosen such that at least part of the axial extent of the riser is disposed between the two locations. The first and second locations might say be towards opposite ends of the riser (with the signals either applied to the riser itself or adjoining structure—eg the vessel or wellhead), or one might be towards an end and another at an intermediate point, say towards a mid point, along the length of the riser.

The provision of two cancellation arrangements may improve effectiveness and/or reduce the power requirements for at least one of the arrangements. This can be particularly useful if one arrangement is mains powered and the other is battery powered. Thus say, a first cancellation arrangement closer to the surface may be mains powered and a second cancellation arrangement closer to the seabed may be battery powered. Thus initial cancellation may take place near the water surface using the first cancellation arrangement and cancellation of noise picked up in the riser between the two cancelation arrangements may be carried out by the second arrangement.

The above examples have shown well installations with a floating platform (or vessel V) supporting the riser 3 and with a well head 2 provided at the seabed. As alluded to above the present ideas and techniques are equally applicable in situations where there is no well head at the seabed but rather say the well head is located on a well head deck of a fixed platform. Such platforms are typically a jack-up platform or Tension Leg Platform (TLP).

FIG. 9 schematically shows a subsea oil and/or gas installation which is similar to that of FIG. 1 above but comprises a Tension Leg Platform P rather than a vessel V. Further the well head 2 is located on a well head deck on the platform P. The downhole metallic structure 1 continues out of the bore hole and becomes the riser 3 at the mudline ML.

Notwithstanding these differences in structure, the installation of FIG. 9 may be provided with a communication system that is the same as in the embodiments described above and the same noise cancellation arrangements as described above may be used. Wherever reference is made above, in relation to FIGS. 1 to 8, to connection to the well head, then in the case of an installation of the type shown in FIG. 9, connection will be made to the metallic structure 1 as it emerges from the bore hole, i.e. at the foot 3*a* of the riser 3. Further wherever there is reference to connection to the vessel V, above, this may be made to the platform P in the FIG. 9 type of arrangement.

Thus in FIG. 9 there is a surface unit 42 connected between the foot 3*a* of the riser 3 and ground and with a cable connection (or acoustic link) 44 to an auxiliary surface unit 43 on the platform P. Further there is a noise cancellation arrangement 5 of the type shown in FIG. 3 with the inputs and outputs of the differential amplifier connected to the foot 3*a* of the riser 3. In this case the seawater electrode 57 is positioned away from the platform structure P.

FIG. 10 schematically shows a well installation that is the same as that shown in FIGS. 1 to 8 other than including a different form of noise suppression. This system is a passive system or a noise suppression system 5' compared to the active cancellation arrangements described above.

Here at least one (and in this embodiment two) large area seawater electrodes 57' is electrically connected to the riser 3 via a connection point 3*b*. The electrode 57' is designed to offer a very low impedance to ground. As an example an electrode having an area of say 200 $m^2$ may be provided offering an impedance to ground of say 0.005 ohms. In one implementation this electrode might be formed as a sleeve provided over and insulated from the riser 3.

Such a large area electrode 57' can divert a significant proportion of current out of the riser 3. Where this is noise current, this is advantageous. Looked at another way, the aim is that ground acts as a current source and current sink to in effect allow suppression of the noise seen in the riser 3 via the connections to the riser.

The or each passive suppression arrangement 5'—ie electrode 57 and connection may preferably be provided closer to the water surface than the seabed. This is because the arrangement 5' will also sink desired communication signals and the receiver in the surface unit (not shown) at the seabed will be detecting the potential difference drop across the combination of the riser 3 portion as far as the connection point 3*b* of the electrode 57' and the impedance to ground offered by the electrode 57'. Thus if the electrode 57' and its connection are close to the seabed there will be very small impedance to ground and a correspondingly small signal to detect.

In an alternative, as well as a passive noise suppression arrangement 5' as defined above, the well installation of FIG. 10 may also include an active noise cancelling arrangement 5 of one of the types described in relation to FIGS. 1 to 8 and shown in dotted lines in FIG. 10. This might typically be provided near the sea bed. Thus again these two noise suppression systems, ie the passive suppression arrangement 5' and the active noise cancelling arrangement 5 can work in unison with the upper one carrying out initial suppression and improving effectiveness of and/or reducing the power requirement for the second, lower one.

In any of the above arrangements, filtering may be used as described in more detail above to help preserve desired signals and/or avoid waste of energy. Thus for example, the passive arrangement may comprise a high pass filter (this might be a series, de-coupling, capacitor to ensure that dc signals provided for cathodic protection purposes are not lost via the large seawater electrode 57.

As will be clear this type of passive system could also be used with a fixed platform type of installation as shown in FIG. 9.

The invention claimed is:

1. A downhole communication system for communication between a first location and a second location in a subsea oil and/or gas well installation, the subsea oil and/or gas well installation comprising:

out of hole metallic structure comprising a riser running upwards away from a mudline, and downhole metallic structure running down into a well, wherein the downhole communication system is arranged so that at least part of a signal path for communications between the first location and the second location is provided by the downhole metallic structure such that, in use, data to be communicated between the first location and the second location is carried by electrical signals in the downhole metallic structure; and the downhole communication system further comprises a first noise cancellation arrangement arranged for sensing a noise signal generated in the out of hole metallic structure and arranged for applying a noise cancelling signal, determined in dependence on the noise signal, to the out of hole metallic structure or the downhole metallic structure to inhibit introduction of electrical noise into the downhole metallic structure from the riser.

2. The downhole communication system according to claim 1 in which the first noise cancellation arrangement comprises current sensing means with a first input connected or connectable to the out of hole metallic structure, a second input connected or connectable to a reference location and an output connected or connectable to the out of hole metallic structure or the downhole metallic structure for applying the noise cancelling signal to the out of hole metallic structure or the downhole metallic structure in dependence on potential difference detected between the first input and the second input.

3. The downhole communication system according to claim 2 in which the reference location comprises a reference electrode.

4. The downhole communication system according to claim 2 in which the reference location comprises a portion of the subsea oil and/or gas well installation.

5. The downhole communication system according to claim 2 in which the current sensing means is connected in accordance with one of following three connection options:

i) the first input is connected or connectable to the riser at a first sensing location, the second input is connected or connectable to a riser at the second sensing location spaced from the first sensing location and the output is connected or connectable to the riser at the first sensing location, the second sensing location or another location;

ii) the first input is connected or connectable to the riser, the second input is connected or connectable to seabed metallic structure and the output is connected or connectable to the riser;

iii) the first input is connected or connectable to the riser, the second input is connected or connectable to a reference electrode and the output is connected or connectable to the riser.

6. The downhole communication system according to claim 2 in which the current sensing means comprises a differential amplifier which has differential amplifier inputs and a differential amplifier output, the differential amplifier comprising a pre-amplifier with pre-amplifier inputs and a pre-amplifier first output, wherein the pre-amplifier inputs act as the differential amplifier inputs to the differential amplifier and the pre-amplifier output is connected to a power amplifier input of a power amplifier, wherein a power amplifier output of the power amplifier acts as the differential amplifier output of the differential amplifier.

7. The downhole communication system according to claim 6 in which the current sensing means comprises a filter.

8. The downhole communication system according to claim 7 in which at least part of the filter is connected between the first output of the pre-amplifier and the input of the power amplifier.

9. The downhole communication systems according claim 1 comprising a noise cancelling unit which comprises current sensing means for sensing a noise current in the out of hole metallic structure and signal output means for outputting the noise cancelling signal.

10. The downhole communication system according to claim 2 in which the current sensing means has a ground connected or connectable to a seawater electrode which is distinct from a reference location.

11. The downhole communication system according to claim 1 in which the first noise cancellation arrangement is arranged to apply noise cancelling signals for cancelling noise signals over a predetermined frequency range.

12. The downhole communication system according to claim 11 in which the predetermined frequency range of the noise cancelling signals has an upper limit determined in dependence on frequencies used in the downhole communication system and a lower limit determined in dependence on the frequencies used in the downhole communication system and whether there is a need to allow cathodic protection currents to flow.

13. The downhole communication system according to claim 1 in which the first noise cancellation arrangement is arranged to apply non dc noise cancelling signals.

14. The downhole communication system according to claim 1 in which the first noise cancellation arrangement comprises a filter for controlling a range of frequencies over which noise cancelling signals are applied to a well head metallic structure or a well head.

15. The downhole communication system according to claim 14 in which the filter comprises a band pass filter arrangement.

16. The downhole communication system according to claim 14 in which a frequency range of a filter passband has an upper limit determined in dependence on first frequencies used in the communication system and a lower limit determined in dependence on the first frequencies used in the communication system and whether there is a need to allow cathodic protection currents to flow.

17. The downhole communication system according to claim 1 in which in the subsea oil and/or gas well installation the first noise cancellation arrangement is deployed with the riser, the first noise cancellation arrangement is retrofitted to the riser or the noise cancellation arrangement is retrofitted at a seabed.

18. The downhole communication system according to claim 17 in which the first noise cancellation arrangement is retrofitted at the seabed, and at least one physical connection is made to the riser for sensing noise signals and/or applying noise cancelling signals, and said at least one physical connection comprises a snatch disconnector to allow disconnection should the riser need to be removed in an emergency shut down.

19. The downhole communication system according to claim 1 comprising a second noise cancellation arrangement arranged for sensing the noise signal generated in the out of hole metallic structure at a location spaced from that at which the first noise cancellation arrangement senses the noise signal and applying a corresponding signal at the location spaced from that at which the first noise cancellation arrangement applies the noise cancelling signal, or at another location spaced from that at which the first noise cancellation ararangement applies the noise cancelling signal.

20. The downhole communication system according to claim 1 further comprising a noise suppression arrangement arranged for diverting the noise signal generated in the out of hole metallic structure away from the downhole metallic structure, the noise suppression arrangement comprising at least one seawater electrode electrically connected to the out of hole metallic structure or the downhole metallic structure to create a current flow path to ground via the at least one seawater electrode, wherein the current flow path has an impedance, at a frequency of said electrical signals, which is no larger than 1/10th of the impedance to the ground that would be seen at the frequency of said electrical signals from an upper end of the riser via the riser and the downhole metallic structure in absence of the noise suppression arrangement.

21. A downhole communication system for a subsea oil and/or gas well installation in which the subsea oil and/or gas well installation comprises:

out of hole metallic structure comprising a riser running upwards away from a mudline;

and downhole metallic structure running down into a well, the communication system comprising a downhole unit for downhole location in the subsea oil and/or gas well installation and a second unit, wherein the communication system is arranged to allow communication between the downhole unit and the second unit over a signal path at least part of which is provided by the downhole metallic structure such that, in use, data to be communicated between the downhole location and a surface is carried by electrical signals in the downhole metallic structure; and the communication system further comprises a noise cancellation arrangement arranged for sensing a noise signal generated in the out of hole metallic structure and arranged for applying a corresponding noise cancelling signal, determined in dependence on the noise signal, to the out of hole metallic structure or the downhole metallic structure to inhibit introduction of electrical noise into the downhole metallic structure from the riser.

22. A downhole communication system for communication between a first location and a second location in a subsea oil and/or gas well installation, the oil and/or gas well installation comprising:

out of hole metallic structure comprising a riser running upwards away from a mudline, and downhole metallic structure running down into a well, wherein the downhole communication system is arranged so that at least part of a signal path for communications between the first location and the second location is provided by the downhole metallic structure such that, in use, data to be communicated between the first location and the second location is carried by electrical signals in the downhole metallic structure; and the downhole communication system further comprises a noise suppression arrangement arranged for diverting a noise signal generated in the out of hole metallic structure away from the downhole metallic structure, the noise suppression arrangement comprising at least one seawater electrode electrically connected to the out of hole metallic structure or the downhole metallic structure to create a current flow path to ground via the at least one seawater electrode, wherein the current flow path has an impedance, at a frequency of said electrical signals, which is no larger than 1/10th of the impedance to the ground that would be seen at the frequency of said electrical signals from an upper end of the riser via the riser and the downhole metallic structure in absence of the suppression arrangement.

23. A riser noise cancelling arrangement for use in the downhole communication system according to claim 1, the riser noise cancelling arrangement comprising current sensing means with a first input connectable to the out of hole metallic structure, a second input connectable to a reference location and an output connectable to the out of hole metallic structure or the downhole metallic structure for applying the noise cancelling signal to the riser in dependence on potential differences detected between the first input and the second input.

24. A method of installing a noise cancelling arrangement for use in the downhole communication system according to claim 1 in which the method comprises one of deploying the noise cancelling arrangement with the riser, retrofitting the noise cancelling arrangement to the riser, and retrofitting the noise cancelling arrangement to the riser at a seabed.

25. A downhole communication method for communication between a downhole location in an subsea oil and/or gas well installation and a second location, the oil and/or gas well installation comprising:

out of hole metallic structure comprising a riser running upwards away from a mudline; and downhole metallic structure running down into a well, the communication method comprising steps of:

using the downhole metallic structure as at least part of a signal path for communications between the downhole location and the second location so that data to be communicated between the downhole location and the second location is carried by electrical signals in the downhole metallic structure; and sensing a noise signal generated in the out of hole metallic structure and applying a corresponding noise cancelling signal, determined in dependence on the noise signal, to the out of hole metallic structure or the downhole metallic structure to inhibit introduction of electrical noise into the downhole metallic structure from the riser.

26. An installation for use in the downhole communication system according to claim 1, wherein the installation comprising the subsea oil and/or gas well installation, wherein the oil and/or gas well installation comprising the out of hole metallic structure comprising the riser running upwards away from the mudline and the downhole metallic structure running down into the well.

* * * * *